US006363647B2

(12) United States Patent
Kaminski

(10) Patent No.: US 6,363,647 B2
(45) Date of Patent: Apr. 2, 2002

(54) FIREARM WITH SAFETY SYSTEM HAVING A COMMUNICATIONS PACKAGE

(75) Inventor: Kevin A. Kaminski, Plainville, CT (US)

(73) Assignee: Colt's Manufacturing Company, Inc., West Hartford, CT (US)

( * ) Notice: Subject to any disclaimer, the term of this patent is extended or adjusted under 35 U.S.C. 154(b) by 0 days.

(21) Appl. No.: 09/827,987

(22) Filed: Apr. 6, 2001

Related U.S. Application Data

(62) Division of application No. 09/152,547, filed on Sep. 14, 1998, now Pat. No. 6,237,271, which is a continuation-in-part of application No. 08/934,525, filed on Sep. 22, 1997, now Pat. No. 5,867,930, which is a division of application No. 08/685,347, filed on Jul. 23, 1996, now Pat. No. 5,704,153.

(51) Int. Cl.[7] ..... F41A 17/00
(52) U.S. Cl. ..... 42/70.11; 42/70.01; 42/70.08
(58) Field of Search ..... 42/70.01, 70.05, 42/70.06, 70.08, 70.11

(56) References Cited

U.S. PATENT DOCUMENTS 4,488,370 A * 12/1984 Lemelson ..... 42/70 R
5,461,812 A * 10/1995 Bennett ..... 42/70.11
5,564,211 A * 10/1996 Mossberg et al. ..... 42/70.11
5,704,153 A * 1/1998 Kaminski et al. ..... 42/70.11
5,867,930 A * 2/1999 Kaminski et al. ..... 42/70.11
5,896,691 A * 4/1999 Kaminski et al. ..... 42/70.11
5,953,844 A * 9/1999 Harling et al. ..... 42/70.06
6,219,952 B1 * 4/2001 Mossberg et al. ..... 42/70.11
6,237,271 B1 * 5/2001 Kaminski ..... 42/70.06

* cited by examiner

*Primary Examiner*—Michael J. Carone
*Assistant Examiner*—Gabriel S Sukman
(74) *Attorney, Agent, or Firm*—Perman & Green, LLP

(57) ABSTRACT

A module having a housing, a battery, control circuitry and electrical conductors. The battery and control circuitry are contained in the housing. The housing is adapted to be removably connected to the frame of a firearm. The electrical conductors are located on the housing and allow the battery and control circuit to be electrically connected to other components of the firearm. The housing can be connected at a hand grip section of the firearm and forms a substantial portion of at least one exterior side of the firearm at the hand grip section.

6 Claims, 12 Drawing Sheets

FIREARM WITH SAFETY SYSTEM HAVING A COMMUNICATIONS PACKAGE

CROSS-REFERENCE TO RELATED APPLICATIONS

This is a divisional of U.S. patent application Ser. No. 09/152,547 filed Sep. 14, 1998, now U.S. Pat. No. 6,237,271, which is a continuation-in-part application of U.S. patent application Ser. No. 08/934,525 filed Sep. 22, 1997, now U.S. Pat. No. 5,867,930, which is a divisional application of U.S. patent application Ser. No. 08/685,347 filed Jul. 23, 1996, now U.S. Pat. No. 5,704,153 which are hereby incorporated by reference in their entireties.

BACKGROUND OF THE INVENTION

1. Field of the Invention

The present invention relates to firearms and, more particularly, to a firearm safety system with communications electronics.

2. Prior Art

U.S. Pat. No. 5,052,138 discloses a magazine module with a microprocessor and a grip module with electronic circuitry. The magazine module also houses batteries. U.S. Pat. No. 5,461,812 discloses a firearm with a transmitter and a receiver, a ring having a transponder worn by a user, and a safety solenoid to block movement of a trigger mechanism.

SUMMARY OF THE INVENTION

In accordance with one embodiment of the present invention, a firearm is provided having a frame, a firing mechanism connected to the frame, the firing mechanism having a trigger, and a firing mechanism interrupter connected to the firing mechanism to prevent firing of the firearm. The interrupter comprises control circuitry, a first switch, and a second switch. The first switch is electrically connected to the control circuitry to signal actuation of the first switch. The second switch is connected to the frame at a hand grip section and electrically connected to the control circuitry to signal gripping of the hand grip section of frame by a user. Both the first and second switches must be actuated before the control circuitry allows the firing mechanism to fire.

In accordance with another embodiment of the present invention a firearm is provided comprising a frame, a firing mechanism, a firing mechanism controller, a first hand grip panel and a second hand grip panel. The firing mechanism is connected to the frame and has a trigger. The firing mechanism controller comprises communication electronics, a battery, a firing mechanism interrupter bar, and an electrically operated driver for moving the interrupter bar. The first hand grip panel is connected to the frame and has a first set of electrical components thereon including at least a portion of the communication electronics. The second hand grip panel is connected to the frame and has a second set of electrical components thereon including the battery and the driver. The first and second sets of electrical components are electrically connected to each other.

In accordance with another embodiment of the present invention a firearm system is provided comprising a firearm and a unit intended to be carried on a user. The firearm has a frame, a firing mechanism connected to the frame, a firing mechanism interrupter connected to the firing mechanism to prevent actuation of the firing mechanism, and a communications package connected to the frame and electrically connected to the interrupter. The unit has a magnetic coupled transponder for receiving a signal from the communications package and transmitting a magnetic coded analog signal to the communications package on the firearm. The firing mechanism interrupter prevents the firing mechanism from being actuated unless the communications package is within range of the transponder and receives the correct magnetic coded analog signal from the transponder.

In accordance with another embodiment of the present invention, a firearm system is provided comprising a firearm and a unit intended to be carried on a user. The firearm has a frame, a firing mechanism connected to the frame, a firing mechanism interrupter connected to the firing mechanism for preventing firing of the firearm, and a first communications package connected to the frame and electrically connected to the interrupter. The unit has a second communications package. At least one of the communications packages is adapted to transmit coded magnetic signals and the other communications package is adapted to read the signals.

In accordance with another embodiment of the present invention a firearm is provided comprising a frame, a firing mechanism connected to the frame, and means for preventing sears of the firing mechanism from contacting each other. The firing mechanism comprises a striker, a trigger, a drawbar connected to the trigger and having a first sear surface, and a second sear surface connected to the striker. The means for preventing prevents the first and second sears from contacting each other when the trigger is pulled by a user. The means for preventing comprises an electrical driver with a shaft adapted to contact the drawbar to move the drawbar in a downward direction and a communications package connected to the driver.

In accordance with another embodiment of the present invention a firearm safety system is provided comprising a first communications system on a firearm, a second communications system carried on a user separate from the firearm, and means for limiting communication between the first and second communications systems, at least partially, to a rearward facing path of less than about 180° at a rear end of the firearm.

In accordance with another embodiment of the present invention a firearm system is provided comprising firearms and units to be carried by users. The firearms each have a safety system with a first communications package. The units to be carried by the users each comprise a second communications package adapted to communicate with at least one of the first communication packages. The second communications package of at least one of the units is adapted to communicate with the first communications package of at least two of the firearms.

In accordance with another embodiment of the present invention a firearm system is provided comprising firearms and units to be carried by users. The firearms each have a safety system with a first communications package. The units to be carried by users each have a second communications package adapted to communicate with at least one of the first communications packages. The first communications package of at least one of the firearms is adapted to communicate with the second communications package of at least two of the units.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

Figure 1:
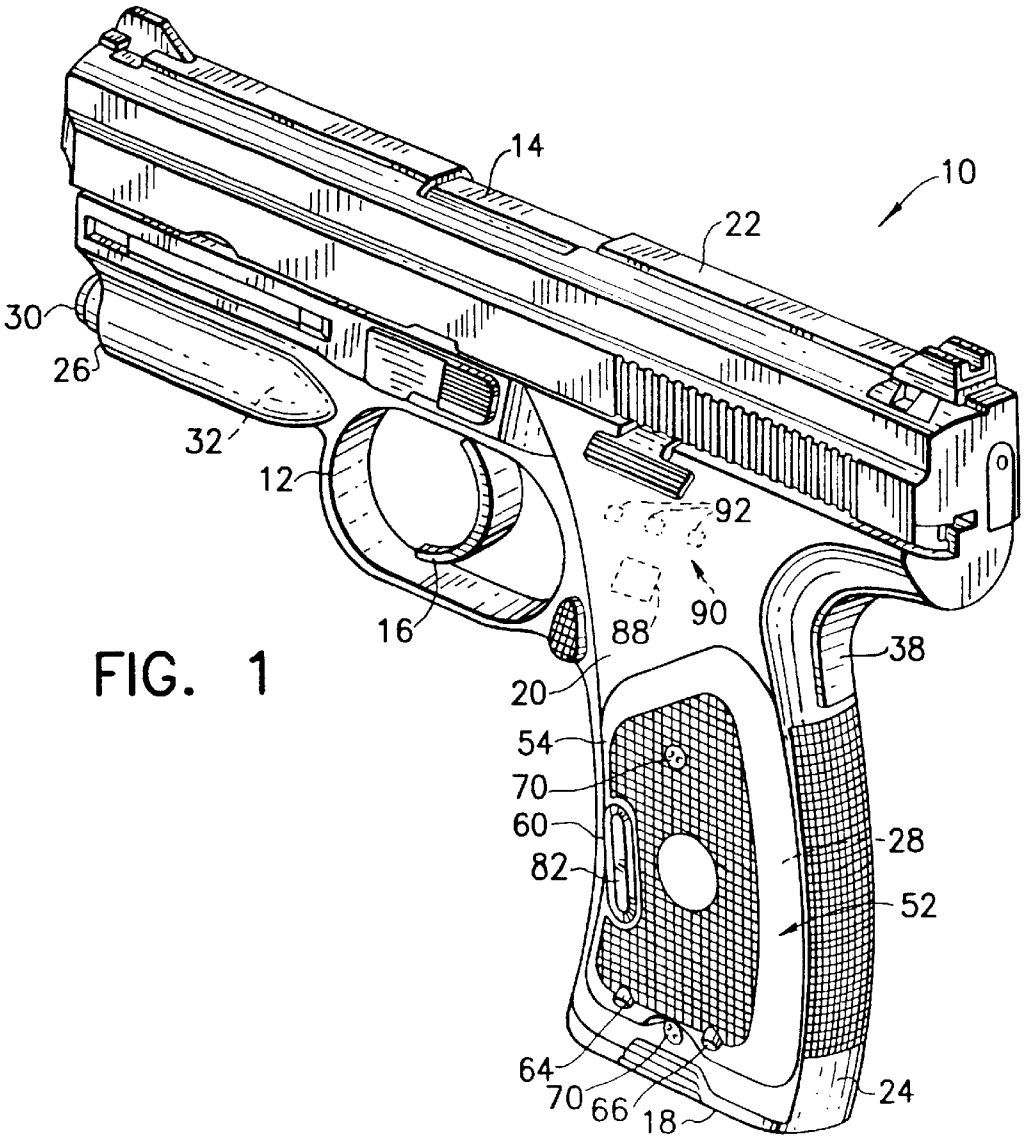
FIG. 1 is a perspective view of a firearm incorporating features of the present invention.

Referring to FIG. 1, there is shown a pistol 10 incorporating features of the present invention. Although the present invention will be described with reference to the single embodiment shown in the drawings, it should be understood that features of the present invention can be embodied in various different forms of alternative embodiments. In addition, any suitable size, shape or type of elements or materials could be used. Features of the present invention may also be incorporated into other various types of firearms. The pistol 10 is a semiautomatic pistol which comprises a frame 12, a barrel 14, a firing mechanism 16, and a removable cartridge magazine 18.

Figure 2:
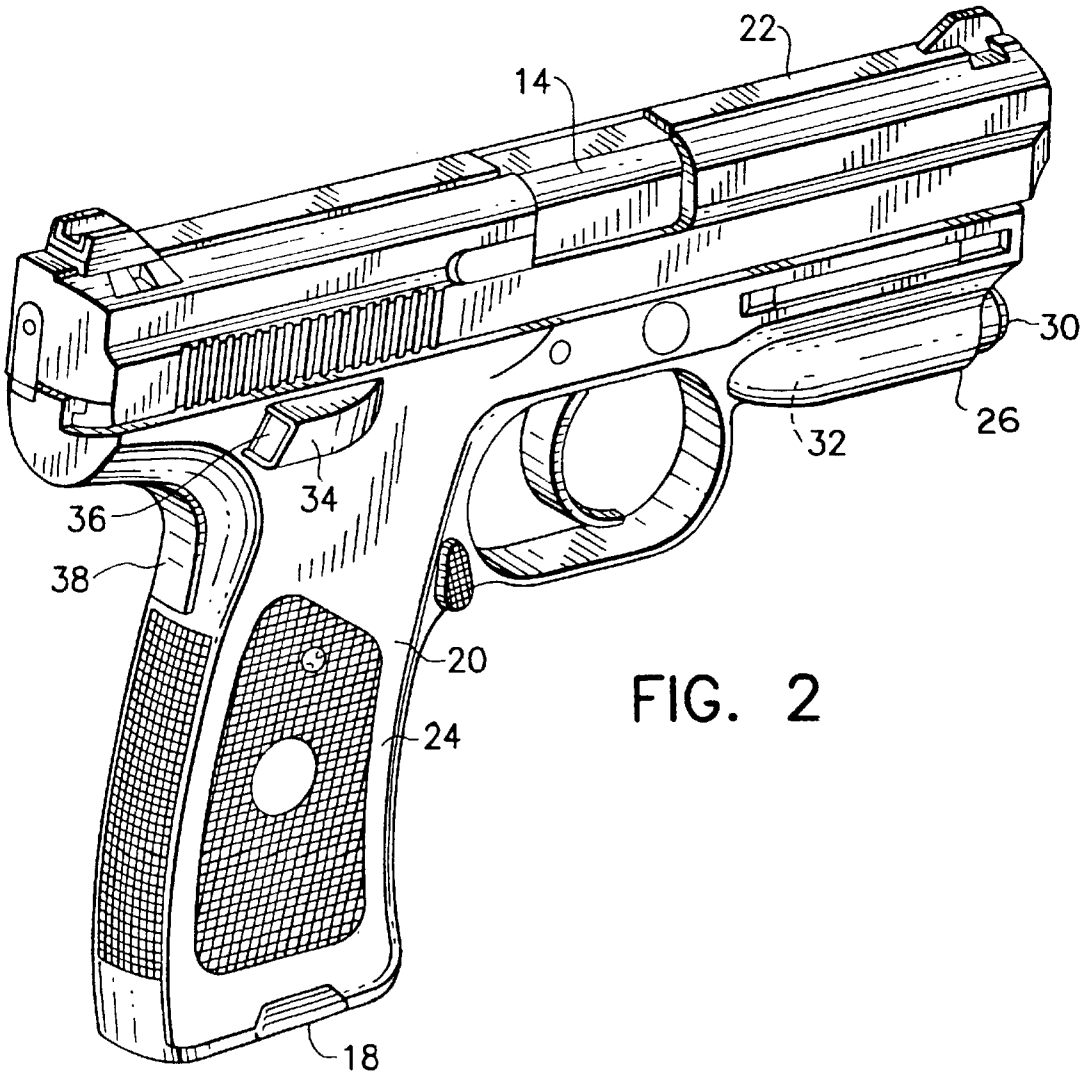
FIG. 2 is a perspective view of the firearm shown in FIG. 1 from an opposite side.

The frame 12 includes a main section 20 and a slide 22. The slide 22 is slidingly mounted on the main section 20. The main section 20 includes a hand grip section 24 and a front laser housing section 26. The hand grip section has a receiving area 28 for removably receiving the cartridge magazine 18. A laser sighting device 30 is mounted in the front laser housing section 26. A battery 32 for the laser sighting device 30 is also mounted in the housing section 26 behind the device 30. In an alternate embodiment the laser sighting device 30 and/or laser battery 32 need not be provided. The section 26 could then be used to house merely a second larger battery for use with the firing mechanism and/or safety system. Alternatively, the section 26 need not be provided. Referring also to FIG. 2, the right side of the main section 20 has a display housing section 34 with a rearward facing electronic display 36, such as an LCD. However, in an alternate embodiment, an electronic display need not be provided. The rear of the main section 20 includes a movable safety lever or grip safety 38 that is depressed when a user grasps the hand grip section 24. The grip safety 38 is preferably a combined mechanical safety to prevent the firing pin from reaching a battery position and, an electrical switch. However, the grip safety 38 could merely be a mechanical safety or an electrical switch. In an alternate embodiment the lever 38 need not be provided.

Figure 3:
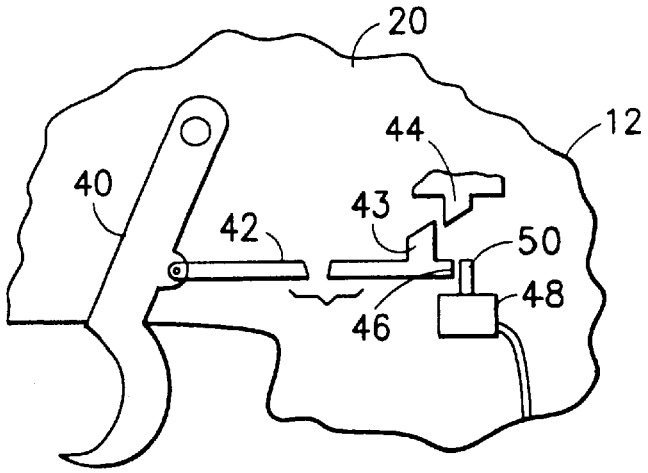
FIG. 3 is a schematic view of a portion of the firing mechanism of the firearm shown in FIG. 1.

Referring also to FIG. 3, the firing mechanism 16 includes a user actuated trigger 40, a trigger bar 42, and sear 44. The trigger 40 is pivotably connected to the main section 20 of the frame 12. In an alternate embodiment the trigger could be slidingly mounted on the frame. The trigger bar 42 is pivotably connected to the trigger 40. The trigger bar 42 has a sear section 43 and a stop surface 46. The sear 44 is connected to a firing pin (not shown) in the slide 22. When the trigger 40 is pulled to rotate rearward by a user, the trigger bar 42 can move the sear 44 rearward by the sear surface 43 pushing against the sear 44. At an end of rearward travel, the sear surface 43 disengages from the sear 44 to allow the firing pin to propel forward to contact and discharge a cartridge.

The firearm 10 also has a safety system with an interrupter or blocker 48. The blocker 48, in the embodiment shown, is a solenoid device with a movable blocking section 50. When the solenoid is energized and de-energized, the blocking section 50 can be moved out of and into the path of the trigger bar 42 behind the stop surface 46. When the blocking section 50 is located in the path behind the stop surface 46, it prevents the trigger bar 42 from moving rearward. Therefore, the firing mechanism is prevented from operating. In a preferred embodiment, the blocking section 50 is located in the path of the trigger bar 42 when the solenoid is de-energized. However, in an alternate embodiment, the blocking section 50 could be located in the path of the trigger bar 42 only when the solenoid is energized. In other alternative embodiments, any suitable type of blocker could be provided, such as a micro-motor with a blocking section. Any suitable type of firing mechanism could also be provided. One alternate embodiment could include a pin which is moved in and out of a blocking position by an electric motor. Another alternate embodiment could include a gear motor moving a pin or a selector gear.

As seen best in FIG. 1, the firearm 10 includes a module 52 that is attached to the main section 20 of the frame 12 at the left side of hand grip section 24. In an alternate embodiment, the module 52 could be suitably sized and shaped to be attached to any suitable location on a frame. It is known in the art to attach hand grip panels to the lateral sides of the hand grip section of a frame of a pistol.

However, such hand grip panels merely function to cover holes in the frame at the hand grip section, form a good hand grip surface, and serve a decorative purpose. The module 52 has a housing 54. The housing 54 has an exterior side that forms a substantial portion of the left exterior side of the firearm at the hand grip section 24. The module housing 54, in addition to other features, performs the same function as one of the old prior art hand grip panels. In an alternate embodiment a module could be alternatively or additionally attached to the right side of the hand grip section.

Figure 4:
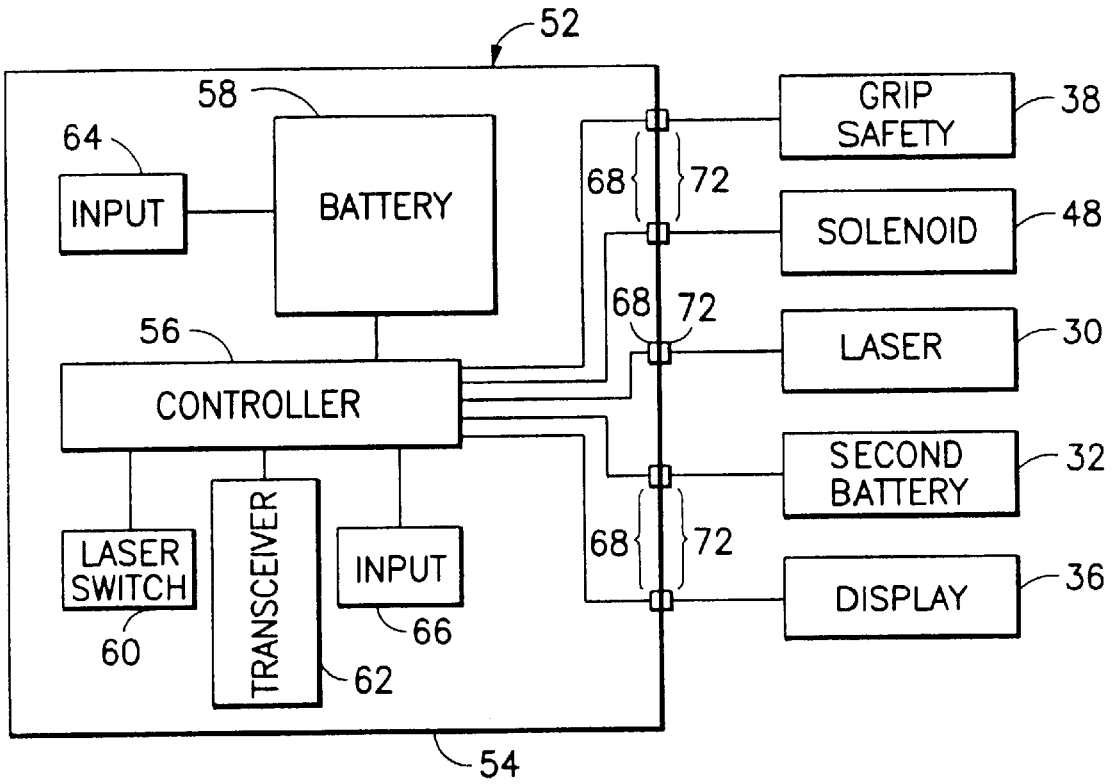
FIG. 4 is a schematic diagram of the control module of the firearm shown in FIG. 1 that is shown connected to other components of the firearm.

Referring also to FIG. 4, the module 52 includes the housing 54, a controller 56, a battery 58, a switch 60, a transceiver 62, a first input 64, a second input 66, and electrical contacts 68. The housing 54 is stationarily connected to the main section 20 of the frame 12. Preferably, the housing 54 is removably connected to the main section 20 by tamper resistant fasteners 70. The exterior of the housing 54, at the left side, is textured for better grip by the user. As seen in comparing FIG. 1 to FIG. 2, the right side of the hand grip section is substantially flat. The left side, however, projects slightly outwardly in order to accommodate the thickness of the components inside the housing 54. The housing 54 is received in a receiving seat of the frame 12. A rear side of the housing 54 is located adjacent the magazine receiving area 28 and forms a portion of a side wall of the receiving area 28. Thus, the module 52 is a separate component from the magazine 18 and does not intrude into the magazine receiving area of the firearm. Preferably, the magazine 18 is of a substantially conventional configuration consisting of merely a housing, a spring and a follower. The electrical contacts 68 are mounted on the housing 54 and make a removable electrical connection with electrical contacts 72 on the main section 20 of the frame. The contacts 72 are electrically connected to the other electrical and electronic components of the firearm; grip safety 38, solenoid 48, laser 30, second battery 32, and display 36. In an alternate embodiment, rather than the contacts 68 mounted on the housing 54, the module 52 could have wire conductors that extend to the various other electrical and electronic components.

Figure 5:
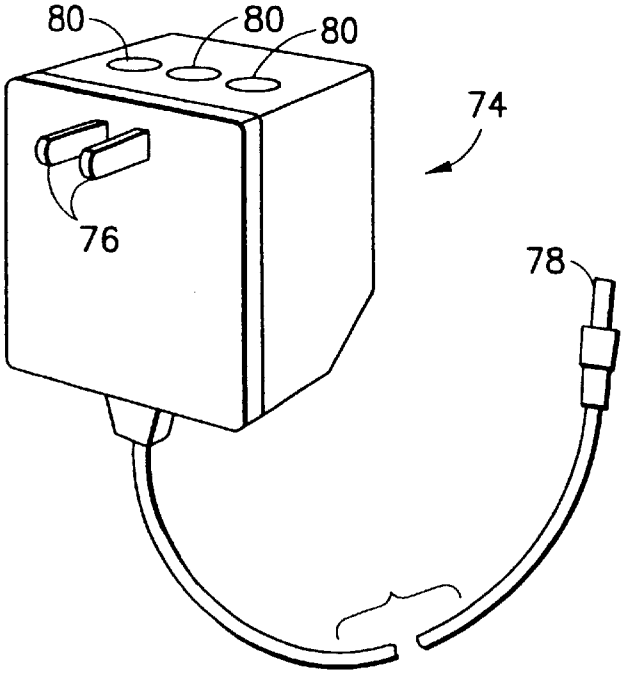
FIG. 5 is a perspective view of a battery recharger for use with the firearm shown in FIG. 1.

The controller 56 preferably comprises a printed circuit board with a micro-computer or microprocessor, and a power relay. The battery 58 is connected to the controller 56. The controller 56 controls whether or not energy from the battery 58 is used to energize the solenoid 48. Preferably, the battery 58 is a rechargeable battery. However, a non-rechargeable battery could be used. The first input 64 is a battery recharger terminal which is connected to the battery 58. A battery recharger 74 for use with the firearm 10 and module 52 is shown in FIG. 5. The recharger 74 is merely an AC transformer with electrical terminals 76 to be inserted into an electrical outlet, a plug 78 for insertion into the terminal 64, and indicator lights 80 for signaling status, such as power ON, charging, and fully charged. However, in alternate embodiments, any suitable type of battery charger could be provided.

Referring back to FIGS. 1 and 4, the switch 60 is a user actuated switch with an actuator 82 located on the exterior side of the housing 54. The actuator 82 can be depressed by a user's finger. The switch 60 is an electrical switch that is electrically connected to the laser 30 and second battery 32 by the controller 56. In an alternate embodiment the switch could be connected to the laser 30 and second battery 32 separate from the controller 56. When a user depresses the actuator 82 the switch 60 is closed to supply electricity from the second battery 32 to the laser 30. In an alternate embodiment the first battery 58 could supply electricity to the laser 30 or both batteries could supply electricity to the laser 30. Other types of actuators could also be provided. In the embodiment shown, the actuator 82 is located at the front of the module housing 54 and has a general bar shape for easy depression by a variety of user hand sizes.

Figure 6A:
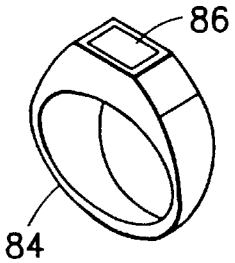
FIG. 6A is a perspective view of a ring of a firing system used with the firearm shown in FIG. 1.
Figure 6B:
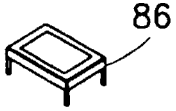
FIG. 6B is a perspective view of a transponder used in the ring shown in FIG. 6A.

The transceiver 62 is adapted to send and receive radio signals. In a preferred embodiment the transceiver 62 is only active when the safety grip 38 is depressed. The controller 56 supplies power to the transceiver 62 from the first battery 58. Referring also to FIG. 6A, a unit 84 is shown that forms a firearm system with the firearm 10. The unit 84 is a finger ring intended to be worn by a user. Referring also to FIG. 6B, the ring 84 has a radio frequency transponder 86. When the transmitter section of the transceiver 62 sends out a signal, the transponder 86 receives the signal and transmits a signal back to the receiver section of the transceiver 62. When this is accomplished the transceiver 62 sends a signal to the controller 56. The controller 56, in turn, moves the solenoid 48 to a non-blocking position such that the pistol 10 can be fired. In a preferred embodiment, once the controller 56 receives a signal from the transceiver 62, the controller 56 stops the supply of power to the is transceiver 62 while the grip safety is still depressed. This serves to conserve power of the first battery 58. The controller 56 keeps the solenoid 48 in its non-blocking position until the grip safety 38 is released. The signal range of the transceiver 62 and transponder 86 are limited. Preferably, the transceiver 62 and transponder 86 have a maximum interactive signal range of about three feet. However, this signal range could be varied based upon power supplied to the transceiver and transponder to between about one inch to about five feet. Preferably, the transceiver and transponder operate in radio frequencies in the 900 MHz range. The signal range could also be configured based upon antenna length and/or shielding in the module 52. The signals transmitted between the transceiver 62 and the transponder 86 are preferably coded, such as with a pulse coding or a frequency coding. Only if the transceiver and transponder are within range of each other, and the proper signals are received by the transceiver, does the controller 56 move the blocker 48 out of its blocking position. The transponder 86 could have its own power supply in the unit 84 or merely use the power from the transceiver signal to supply the return signal to the transceiver. Rather than the transponder 86, the unit 84 carried or worn by the user could have a transceiver and additional circuitry. Preferably, the signal frequency and/or recognition code of each firearm/unit pair is unique such that only a designated firearm and unit can be used together. However, groups of firearm/unit pairs could be similarly programmed, such as for pairs of police officer partners.

In an alternate embodiment, the transceiver could be located in another item, such as a police badge. In another alternate embodiment, the transceiver could be carried in a location that the user could easily throw away from him, such as if the user is in a struggle with a criminal for the firearm. By throwing the transponder unit out of the range of the firearm, the firearm becomes unable to fire, thereby preventing the criminal from shooting the rightful user with his own firearm. In the alternate embodiment where the grip safety 38 is not electrically connected to the controller 56, the firearm 10 could have a switch 88, such as a magnetic reed switch, that is activated when the firearm 10 is removed from a holster that has a magnet. The unit 84 could also comprise an emergency off switch that could be activated by the user. The firearm 10 can also comprise an emergency control 90 to mechanically place the blocker 48 in a non-blocking position. Preferably the emergency control 90 is a code control mechanism having push buttons 92. The push buttons have to be actuated in a predetermined sequence before the blocker 48 is manually moved to a non-blocking position. With this embodiment, even if the battery 58 fails or if the blocker 48 fails or if the transceiver 62, transponder 86 or any part of the module 52 fails, a user who knows the code for the control 90 can place the firearm into operation.

Figure 7:
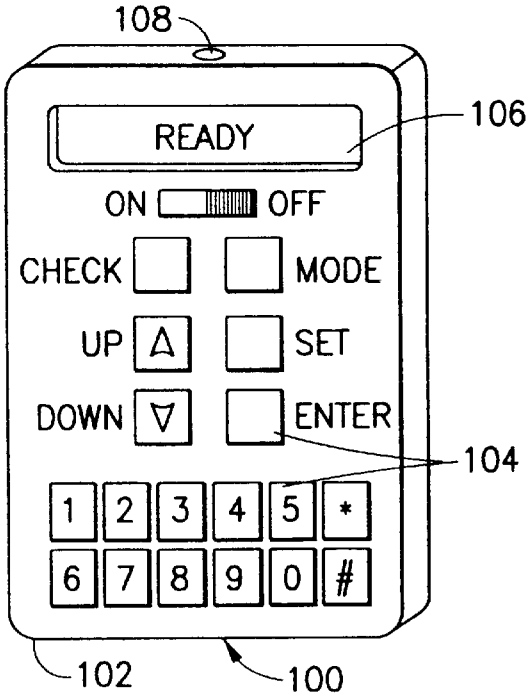
FIG. 7 is a perspective view of a programming unit for use with the firearm shown in FIG. 1.

Referring also to FIG. 7, a programming unit 100 for use with the firearm 10 is shown. The programming unit 100 has a housing 102, keys 104, a display 106, and an infrared transmitter 108. The second input 66 on the module 52 is an infrared receiver. The programming unit 100 can be used to program the controller 56 by infrared signals received by the input 66. The programming of the controller 56 could include any suitable coding instruction or operational instruction. In alternate embodiments, other types of programming units could be provided. The means for re-programming could also be other than infrared, such as a direct electrical connection by a conductor or radio signals. Alternatively, the module 52 need not be re-programmable and may be sealed to prevent re-programming. The module 52 can display program codes on the LCD display 36 and may also be provided with a signaler to give audible tones as programming is changed and/or to signal low battery power. If desired, the unit 100 could be used to turn the signaler ON and OFF. Removal of the module 52 from the frame 12 preferably makes operation of the firing mechanism impossible without removing the blocker and/or adding additional parts. Modules 52 could be provided on both the left and right sides of the hand grip section for added redundancy in both the power supply and the safety systems.

As noted above, the module 52 is preferably attached to the frame 12 by tamper resistant fasteners. The fasteners would be specially attached during manufacture and could require return to the factory for removal. Therefore, if the pistol 10 is stolen or wrongfully taken away from the user, it will take considerable time and effort to remove the module 52 to attempt to remove the safety system. However, this helps to prevent the pistol 10 from being immediately used against the rightful user.

Figure 8:
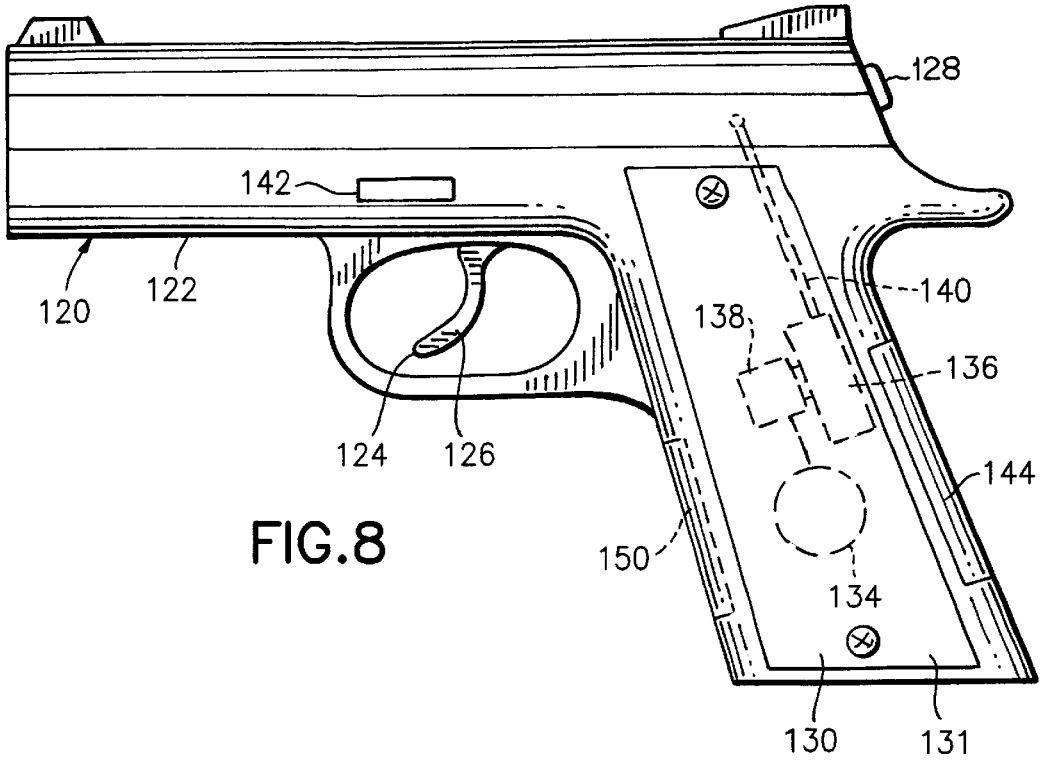
FIG. 8 is an left side elevational view of an alternate embodiment of a pistol incorporating features of the present invention.
Figure 9:
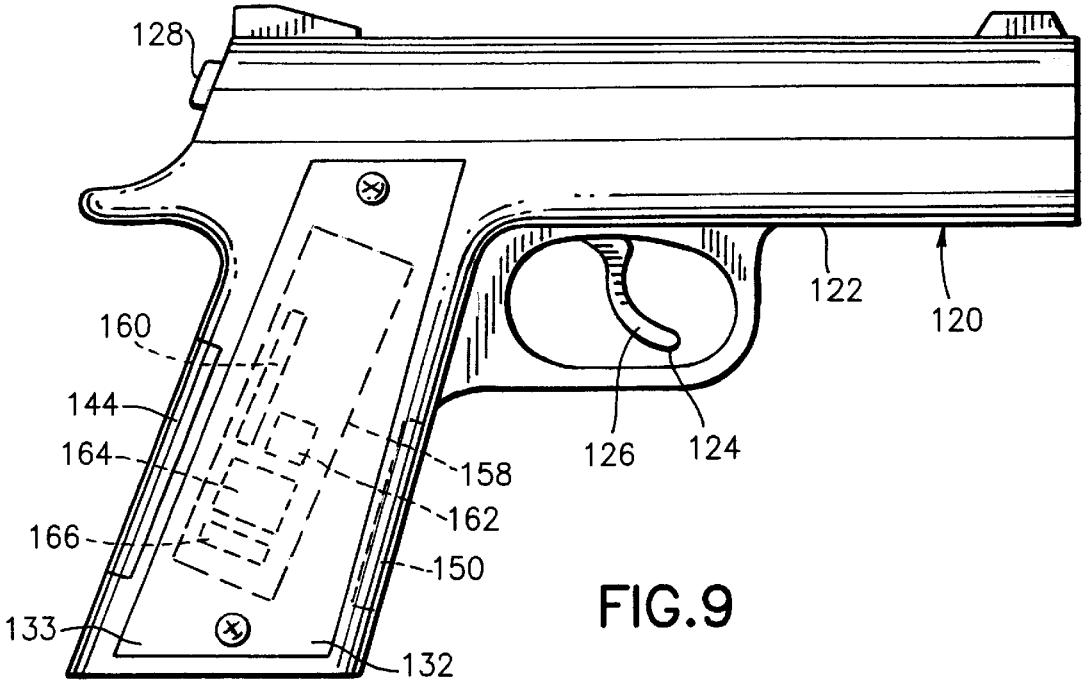
FIG. 9 is a right side elevational view of the pistol shown in FIG. 8.
Figure 8A:
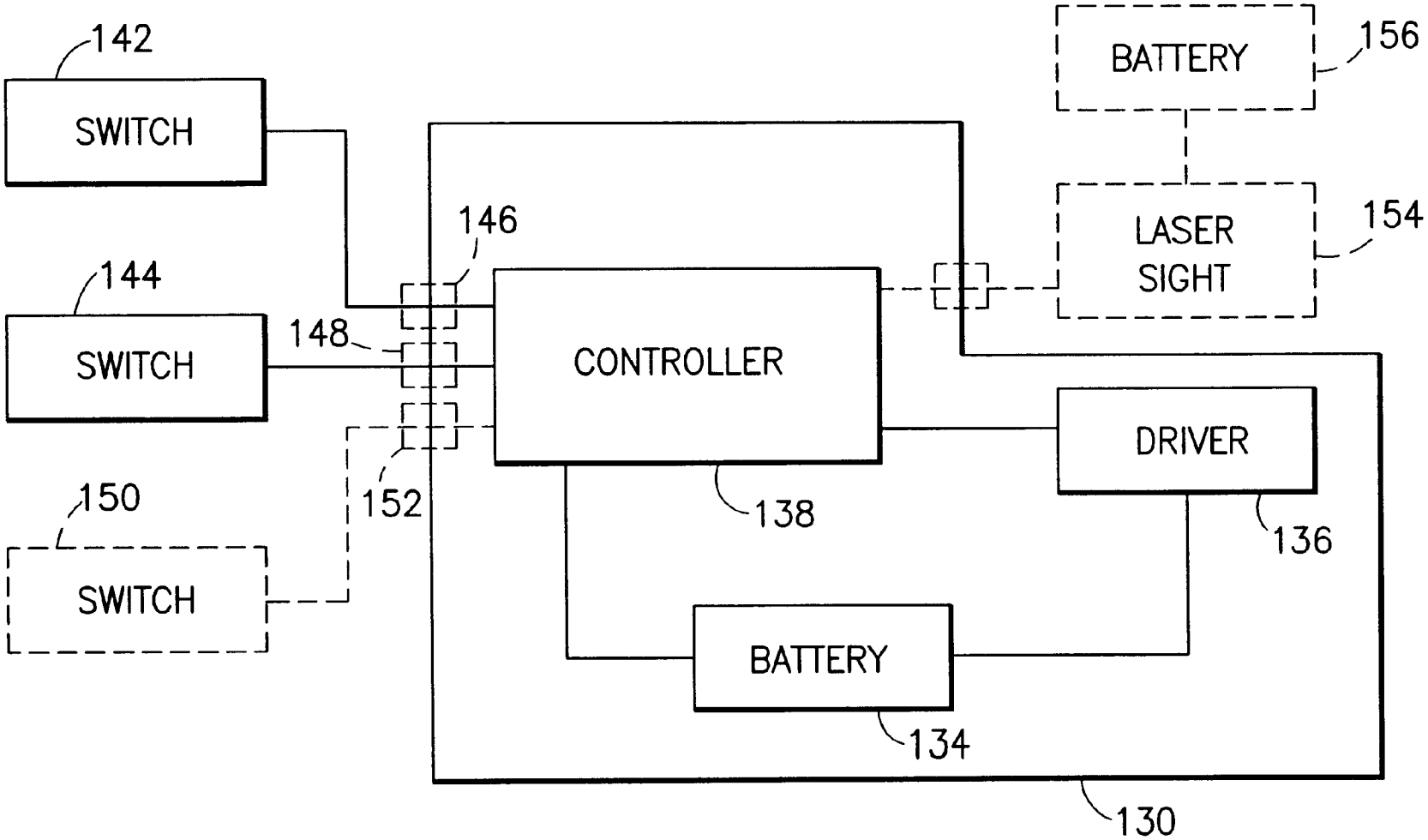
FIG. 8A is a schematic diagram of some of the components of the pistol shown in FIG. 8.

Referring now to FIGS. 8 and 9 there are shown schematic left and right side elevational views of an alternate embodiment of a pistol 120 incorporating features of the present invention. The pistol 120 has a frame 122, a firing mechanism 124 including a trigger 126 and a hammer or striker 128, and a firing mechanism interrupter system. The pistol 120 has a left side hand grip panel 130 and a right side hand grip panel 132 fixedly removably connected to the frame 122. The panels 130, 132 preferably have housings 131, 132 made of molded polymer material that are attached to the frame by fasteners. Mounted to or inside the left side panel 130 is a battery 134, a driver 136 and a driver controller 138. The driver 136 has a rod or bar 140 which extends past the top side of the left side panel 130. Referring also to FIG. 8A a schematic diagram is shown of the left side panel 130 and its electrical connections to some other components of the pistol. Part of the safety system of the pistol 130 includes two sensors or switches 142, 144. The first switch 142 is a trigger switch which is actuated when a user moves the trigger 126. The second switch 144 is a palm grip switch. The trigger switch 142 is electrically connected to the controller 138 by an electrical wire or a conductive lead on the frame 122, such as when the frame is at least partially comprised of a dielectric molded polymer material. The panel 130 could have an electrical contact 146 on its housing 131 for making a removable electrical connection with the conductor from the trigger switch 142. The palm grip switch 144 is connected to the frame 122 at the rear end of the hand grip area of the pistol. The palm grip switch 144 is adapted to signal the controller 138 when a user is grasping the pistol with his or her palm against the switch 144. The palm grip switch 144 is electrically connected to the controller 138 by an electrical wire or a conductive lead on the frame 122. The panel 130 could have an electrical contact 148 on its housing 131 for making a removable electrical connection with the conductor from the palm grip switch 144 or directly on a contact of the switch 144.

The controller 138 is preferably a computer such as a microprocessor. The controller 138 is connected to the driver 136 to control actuation of the driver 136. The battery 134 is used to power the controller 138 and the driver 136. The driver 136 is an electrically operated driver such as a solenoid or a micro motor. The controller 138 is adapted to allow actuation of the driver 136 only if both the switches 144, 150 are actuated. In other words, only if a user's palm is actuating the palm grip switch 144 and fingers are actuating the finger switch 150 will the controller 138 allow the driver 136 to be actuated. Alternatively, only if either the palm grip switch 144 or the finger switch 150 are actuated will the controller 138 allow the driver 136 to be actuated. In this type of embodiment, the trigger switch 142 can be used to actuate a laser sight. However, the trigger switch 142 could be used in the firing mechanism control scheme. The driver rod 140 extends from the driver 136 to a portion of the firing mechanism 124. In a first position of the rod 140 the firing mechanism 124 is prevented from operating to cause a discharge of the pistol. In a second position of the rod 140 the firing mechanism 124 is allowed to operate to cause a discharge of the pistol. The rod 140 is moved between the two positions by the driver 136. The rod 140 could function as part of a blocker or alternatively as part of a movement system such as moving the drawbar of the pistol to prevent interaction with a sear of the hammer. This feature is further described below.

In an alternate embodiment of the invention the pistol 120 could have a third switch 150, such as a finger grip switch. As shown in dotted lines in FIG. 8, in one embodiment the finger grip switch 150 is connected to the frame 122 at the front of the hand grip area of the pistol such that the switch 150 can be actuated by a user's fingers when the pistol is grasped by the user. As shown in FIG. 8A this third switch 150 would be electrically connected to the controller 138, such as by a contact 152 on the housing 131 of the panel 130. The controller 138 could be programmed to allow actuation of the driver 136 to move the driver rod 140 between its two positions only if all three switches 142, 144 and 150 are actuated. In one embodiment actuation of the palm grip switch 144 signals the communications package 158 in the right panel 132 to leave a standby mode and go into an active mode. The package 158 transmits a polling signal to locate a transponder. If the correct transponder is within the enabling zone, the transponder will exit a standby mode and send a coded signal to the firearm, then the firearm will become enabled. If there is no correct transponder within the enabling zone, the firearm remains disabled. The inactive, standby mode will require only a very small current to maintain the microprocessor's operation, while also maintaining ID codes in memory, and monitoring battery status. The palm and finger switches 144, 150 could be connected in parallel such that only one needs to be actuated to operate the firearm. Alternatively, or additionally, the third switch 150 and/or the first and second switches 142, 144 could be used to actuate, via the controller 138, an additional electric or electronic component on the pistol, such as a laser sight 154 shown in dotted lines in FIG. 8A. In this alternate embodiment the laser sight 154 can have its own separate battery 156 separate from the battery 134. The third switch 150 could alternatively be connected directly to the laser sight 154 without use of the controller 138.

Figure 9A:
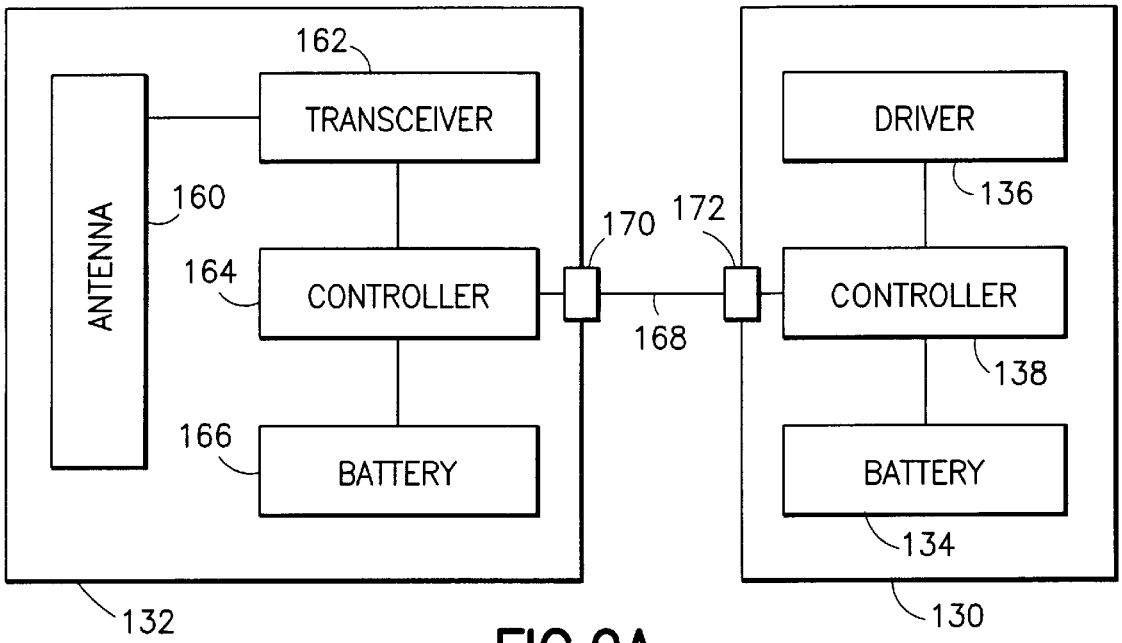
FIG. 9A is a schematic diagram of connection between the two panels of the pistol shown in FIGS. 8 and 9.

The right panel 132 as seen in FIG. 9 has an electronic communications package 158 connected thereto or therein. In this embodiment the package 158 includes an antenna 160, a transceiver 162, a controller 164 and a battery 166. Referring also to FIG. 9A, the transceiver 162 is connected to the controller 164. The right panel controller 164 is electrically connected to the left panel controller 138 by at least one conductor 168. The conductor 168 could be a wire or a conductive lead on the frame 122. The panels 130, 132 could have contacts 170, 172 for making removable electrical connection to the conductor 168. In an alternate embodiment a non-removable connection could be made or the two panels 130, 132 could be provided with a common housing. In addition, the two panels 130, 132 could have only a single controller located in either one of the panels and/or the two panels 130, 132 could have only one battery rather than the two separate batteries 134, 166. In another alternate embodiment the two panels 130, 132 are interchangeably located on the frame 122. Thus, the two panels 130, 132 could be repositioned on the different sides of the frame to reconfigure the pistol for right handed and left handed shooters. In a preferred embodiment the conductor 168 actually provides multiple separate electrically conductive signal paths.

Figure 10A:
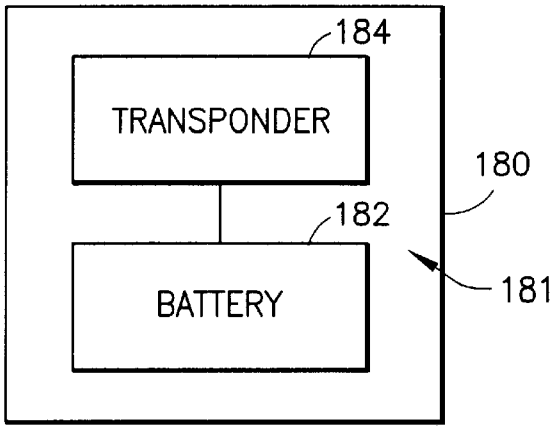
FIG. 10A is a schematic diagram of the transponder unit to be worn by a user.

The left panel controller 138 is preferably programmed such that when a predetermined one, or more than one, of the switches 142, 144, 150 are actuated, the left panel controller 138 sends a signal to the right panel controller 164. The left panel controller 138 does not actuate the interrupter 136, 140 yet. The right panel controller 164 then activates the transceiver to transmit a polling signal. Referring also to FIG. 10A, the polling signal would be received by a unit 180 worn or carried by the user which has a second communications package, if within range of the polling signal. The second communications package preferably comprises a battery 182 and a transponder 184. The type of transponder used in the unit 180 will depend upon the type of transceiver 162 being used in the pistol 120. The polling signal, depending on the configuration of the transceiver 162, will be either a radio wave signal or a magnetic coded signal. The transponder 184 is adapted to receive the polling signal and generate a return signal. The unit 180 could also have means, such as a controller with a microprocessor and memory to determine if the polling signal is a predetermined acceptable polling signal(s), and generate the return signal. The return signal, depending on the configuration of the transceiver 162, will be either a radio wave signal or a magnetic coded signal, such as a 32 or 16 bit signal or an analog signal. The return signal, if within range of the transceiver 162, will be received by the transceiver. The right panel controller 164 will then determine if the return signal is a predetermined acceptable return signal(s). The controller 164 could have a memory with the predetermined acceptable return signal(s). If an acceptable return signal has been received, the right panel controller then sends a signal to the left panel controller 138. The left panel controller 138 then actuates the driver 136 to move the rod 140. If the right side controller 164 does not receive an acceptable return signal, for whatever reason, the interrupter system will prevent the firing mechanism from firing the pistol. Likewise, if the two switches 142, 144 are not both actuated, preferably the interrupter system will prevent the firing mechanism from firing the pistol.

In one type of embodiment the interrupter system is configured to have a home position in which the firing mechanism can fire the firearm if any of the two pistol batteries 134 or 166 fail. This type of embodiment would preferably be for law enforcement use. In such an embodiment, with good batteries, actuation of one or both of the switches 144, 150 would cause the driver 136 to move the rod 140 to a firearm disabling position and stay there unless and until the communications package 158 received an acceptable return signal. Thus, this pistol would be configured to be normally armed. In another type of embodiment, such as for use in a home, the pistol could be configured to be normally disarmed. Only upon receiving an acceptable return signal would the firearm be able to become armed. Thus, if the firearm is stolen from an owner's house, the thief cannot overcome the interrupter system by merely removing the batteries 134, 166.

In a preferred embodiment, communication between the two communications packages 158, 181 includes at least one of either the polling signal or the return signal being a magnetic coded signal from a magnetic coupled communication system, such as a magnetic coupled transponder system. A magnetic coupled communication system generally comprises a magnetic reader or magnetic field communications receiver and a magnetic field transmitter or transponder. Coupling is by means of coils for antennas. Due to the magnetic method of signaling, range is limited to only a number of inches being determined by fields generated between the effective North and South poles of the reader. A magnetic coupled transponder system is preferred because of the limited range of detection of the transponder from the reader and the reader's magnetic field. Magnetic transponders, also known as magnetic tags, are used for tagging animals, labeling gas bottles, electronic automobile key identification and factory automation. In a preferred embodiment the system uses a A249 chip manufactured by Smartlink of Berkely, Calif. In the preferred embodiment the system will communicate only by the means of a magnetic field, and the code transmission will be in the form of analog signals.

RF applications are most noteworthy in that they operate "seamlessly", requiring no conscious action for the user to perform (e.g. pushing a button); they are not overly alignment critical, meaning that the user doesn't have to line up a button with a button-hole; a larger enabling zone is possible; and it makes no difference whether the user is wearing gloves or if the users hand is injured. However, there is a fear that RF technology will be too open to being defeated by jamming or it will be easily intercepted to reproduce enabling devices. To overcome this fear, the present invention does not need to involve an RF signal. RF is composed of electrostatic and magnetic field components that together allow the RF signal to travel long distances, or propagate. Our system can communicate only by the means of magnetic field, and the code transmission will be in the form of analog signals.

Magnetic fields carrying analog signals reduce the risks of communications between the firearm and the transponder being detected, since the communicating range is so short, and there is no rapid transition between signal elements in a continuously varying analog signal as there is in digital (0/1) communications. Sharp signal transitions in digital communications generate large electrostatic fields that are easily detected. Communication between the firearm and the transponder is preferably an active tag system rather than a passive tag system. An active tag system means that both the base communicator in the firearm and the user worn transponder will transmit using separate power sources each will have their own battery. Although a passive tag transponder would not require it's own power source, an active tag system has too many benefits to dismiss. The active system operating frequencies can be low, suited for short-range operation, and requires very little power to operate. The active tag system can communicate using only magnetic fields and analog coded signals, making jamming or code interception and reconstruction very difficult.

The interrupter system will preferably mechanically "disconnect" the trigger, using the firearms own drawbar disconnect system. This should result in disabling the handgun without the user being capable of applying any force on the disabling mechanism.

Figure 9B:
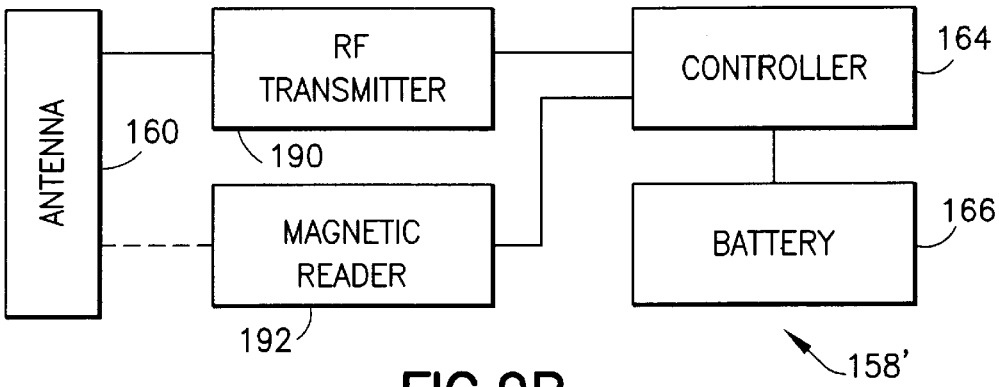
FIG. 9B is a schematic diagram of an alternate embodiment of some of the communications electronics in the firearm.
Figure 10B:
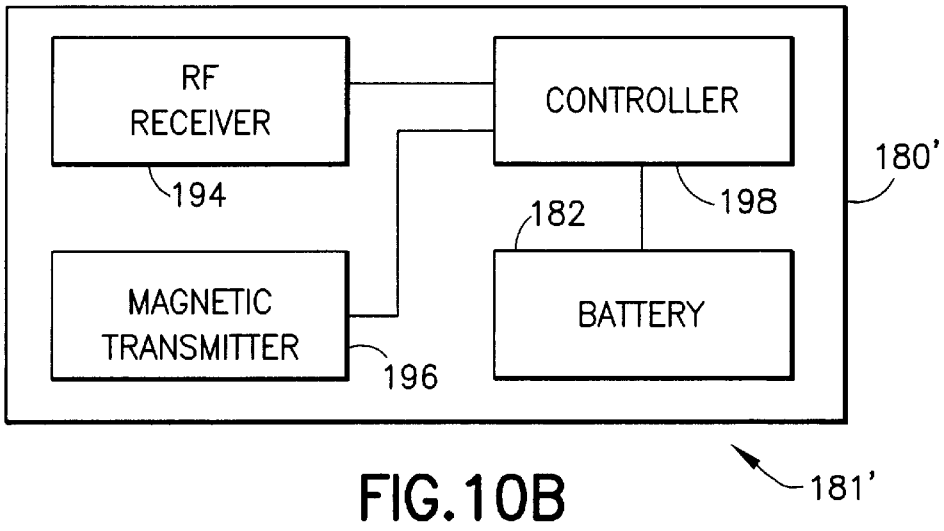
FIG. 10B is a schematic diagram of another embodiment of the transponder unit shown in FIG. 10A.

FIGS. 9B and 10B show alternate embodiments of the communications packages 158' and 181'. In this embodiment the firearm communications package 158' has the controller 164, the battery 166, the antenna 160, an RF transmitter 190 and magnetic reader 192. The unit 180' has the batter 182, an RF receiver 194, a magnetic transmitter 196, and a controller 198. The transmitter 190 would transmit an RF polling signal to the receiver 194. The controller 198 could compare the polling signal to stored acceptable polling signals and, if one is received cause the transmitter 196 to transmit a return coded magnetic analog signal. If within range of the reader 192, the reader 192 will send the signal to the controller 164 for comparison with stored acceptable return signals.

Figure 9C:
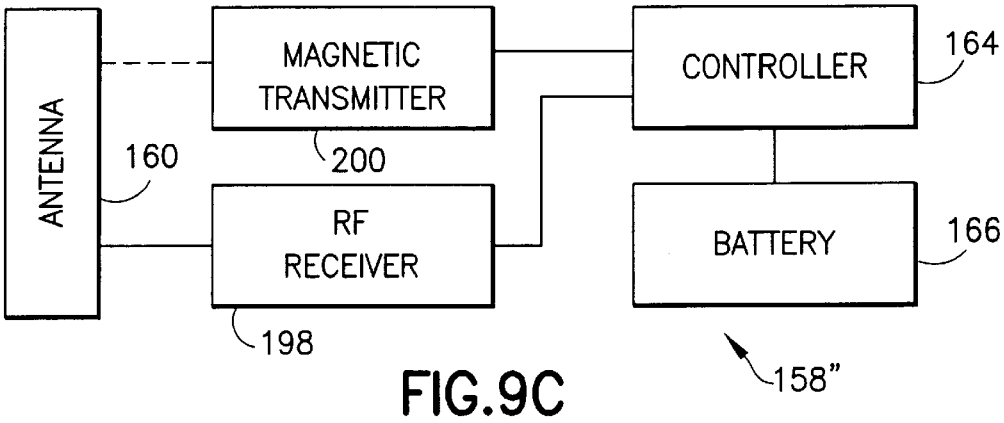
FIG. 9C is a schematic diagram of another alternate embodiment of some of the communications electronics in the firearm.
Figure 10C:
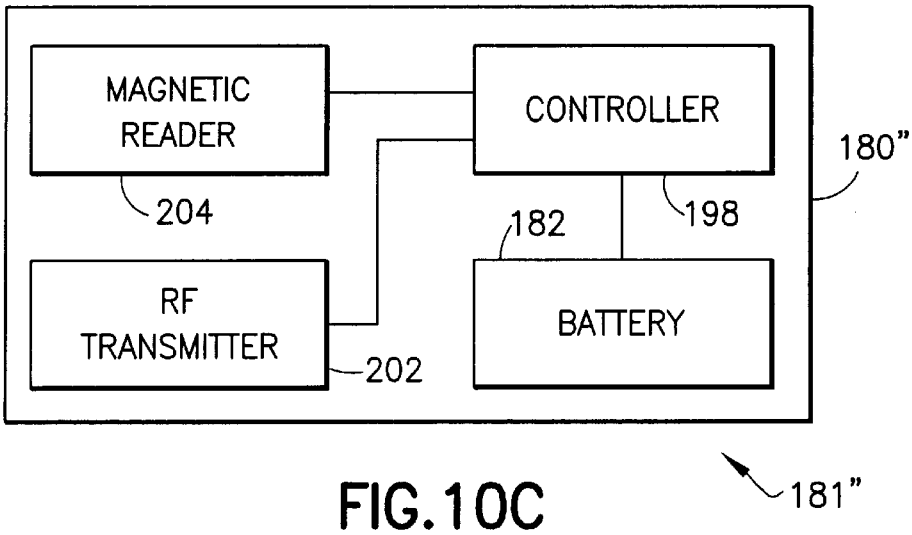
FIG. 10C is a schematic diagram of another embodiment of the transponder unit shown in FIG. 10A.

FIGS. 9C and 10C show alternate embodiments of the two communications packages 158" and 181". In this embodiment the firearm communications package 158" has the controller 164, the battery 166, the antenna 160, an RF Receiver 198 and a magnetic transmitter 200. The unit 180" has the battery 182, on RF transmitter 202, the magnetic reader 204, and the controller 198. The transmitter 200 would transmit the polling signal as a magnetic signal to the reader 204, the controller 198 could compare the polling signal to stored acceptable polling signals and, if one is received, cause the transmitter 202 to transmit a return radio wave signal. Receiver 198 will send the signal to the controller 164 for comparison with stored acceptable return signals.

Figure 11A:
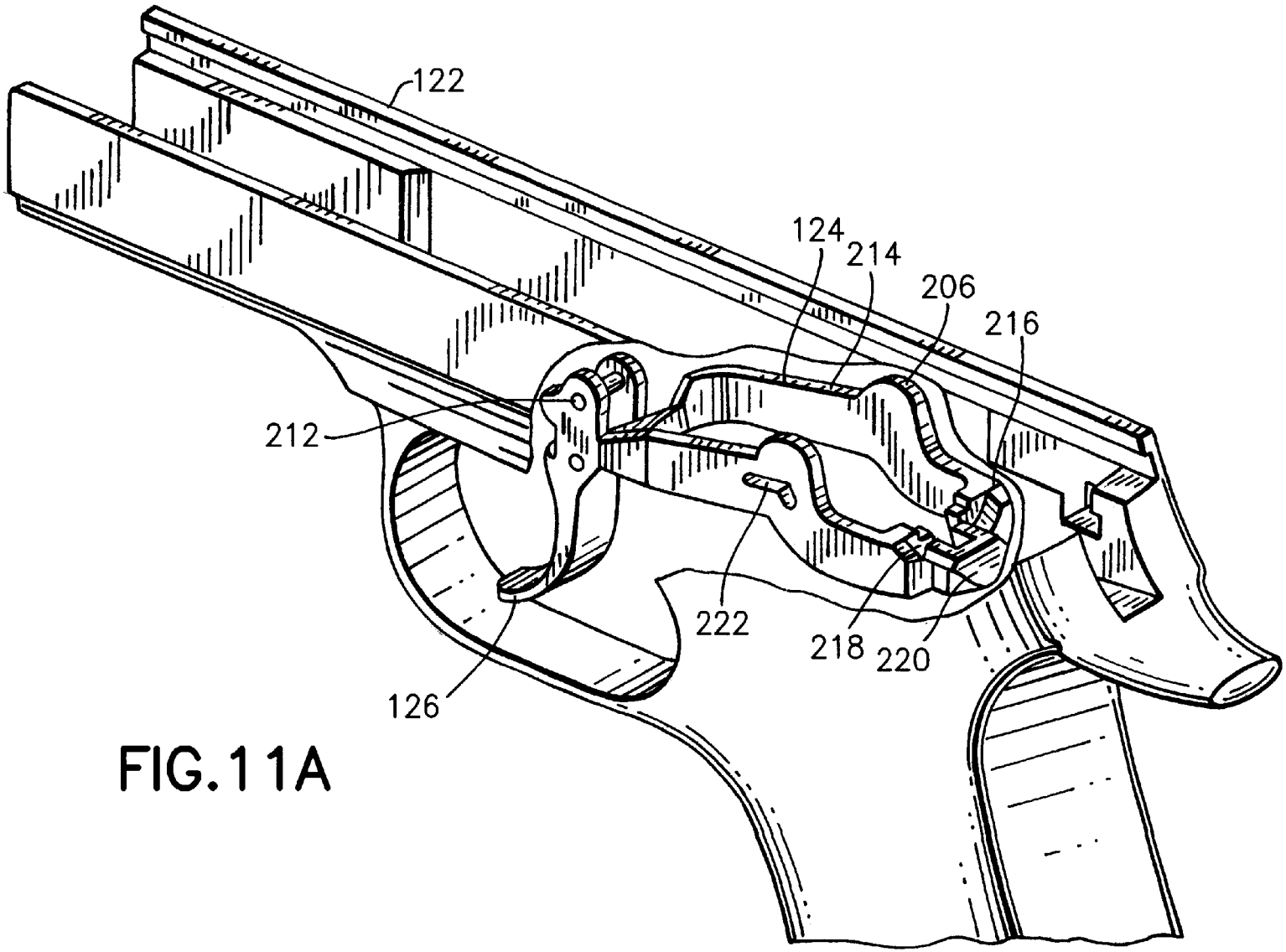
FIG. 11A is a partial perspective view with a cut-away section of the pistol shown in FIG. 8.
Figure 11B:
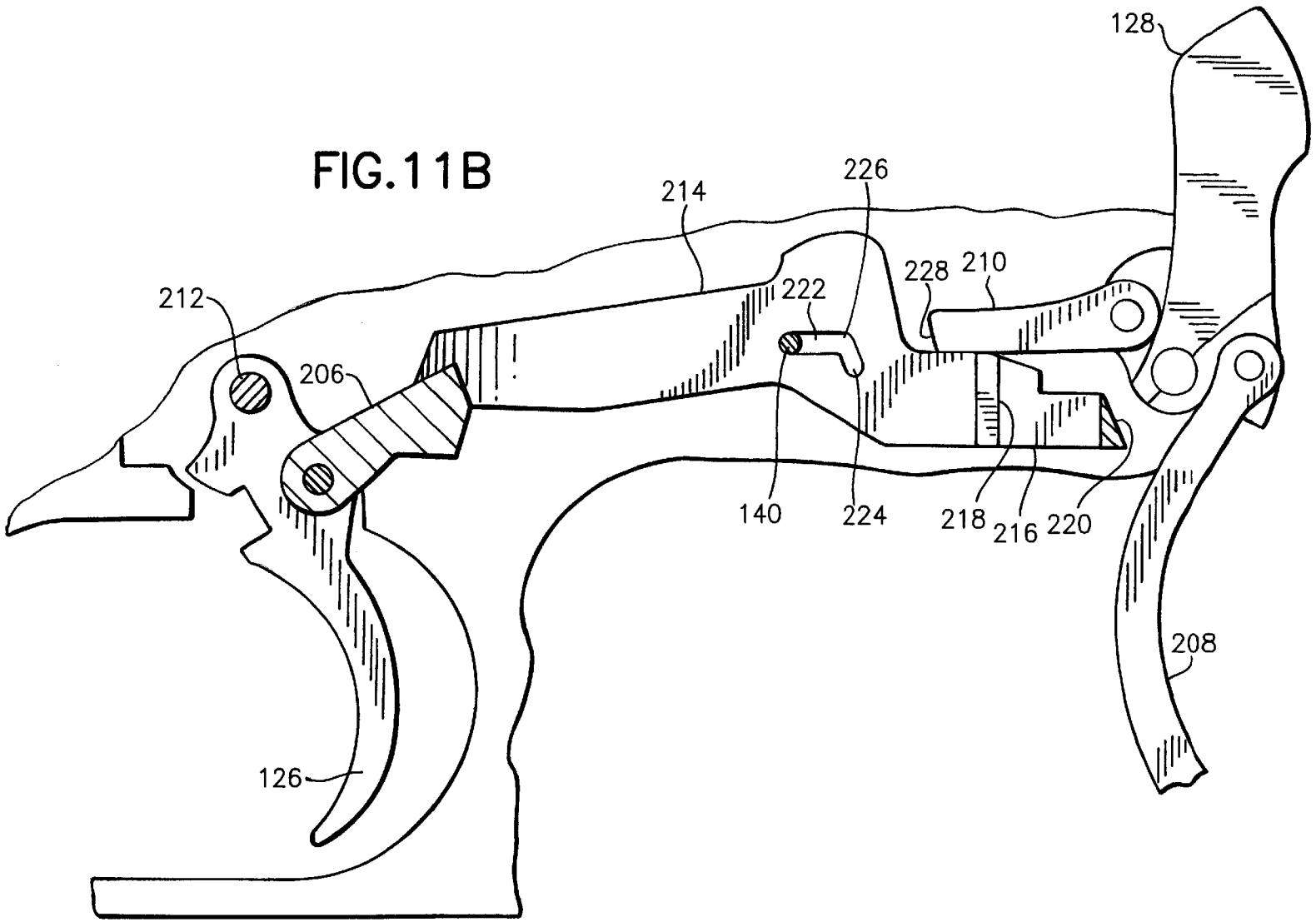
FIG. 11B is a partial side view with cut-away sections of part of the firing mechanism of the pistol shown in FIG. 8.

Referring now to FIGS. 11A and 11B, one embodiment of interaction between the firing mechanism 124 and the interrupter system will be described. In this embodiment the firing mechanism 124 includes the trigger 126, a drawbar 206, the hammer 128, a hammer spring 208, and a hammer sear 210. The trigger 126 is pivotably mounted to the frame 122 at pin 212. The drawbar 206 has a front end pivotably mounted to the trigger 126, a middle section 214, and a rear end 216. The rear end 216 has a sear surface 218 and a camming ramp 220. The middle section 214 has a cam slot 222. A top end of the driver bar 140 is located in the cam slot 222. FIG. 11B shows the position of the drawbar 206 when the trigger 126 has been pulled back and when the driver bar 140 is in a down position. With the driver bar 140 in the down position and the trigger in a forward non-pulled position the bar 140 is at the bottom 224 of the cam slot 222. The sear surface 228 of the sear 210 is located behind the sear surface 218 of the drawbar 206. As the trigger is pulled back by the user, the drawbar 206 moves rearward. However, interaction between the drawbar 206 in the cam slot 222 and the driver bar 140 cams the rear of the drawbar downward thereby preventing the two sear surfaces 218, 228 from engaging each other and preventing the drawbar 206 from moving the hammer 128 to its cocked position. With the driver bar 140 in an up position, the top of the bar 140 is in the top 226 of the cam slot 222 when the trigger is first pulled. Therefore, the driver bar 140 does not cam the rear end of the drawbar 206 downward when the trigger is pulled. The firing mechanism thus pushes the sear 210 rearward to rotate the hammer to its cocked position with the two sear surfaces 218, 228 separating when the camming ramp 220 is cammed downward at the end of rearward travel of the drawbar. In an alternate embodiment the driver bar could be held in an up position to keep the two sear surfaces separated. Other types of camming systems could be provided or no camming system need to be provided if a straight slot is used and the driver 140 has a long enough up and down travel distance. The present invention could also be used with other types of triggers, drawbars, hammers and sears.

Figure 12A:
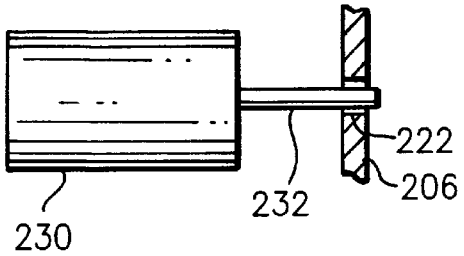
FIGS. 12A and 12B show an alternate embodiment of the interaction of the interrupter driver and drawbar.
Figure 12B:
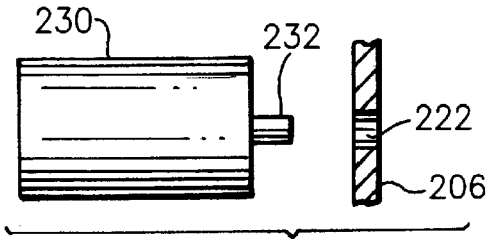

Referring also to FIGS. 12A and 12B an alternate embodiment of interaction with the drawbar 206 is shown. In this embodiment the interrupter system has a driver which is a solenoid 230 having a shaft 232. The solenoid 230 is not part of the hand grip panel, but is instead located at a lateral side of the drawbar 206. The solenoid is adapted to move its shaft 232, laterally into and out of the slot 222.

Figure 13:
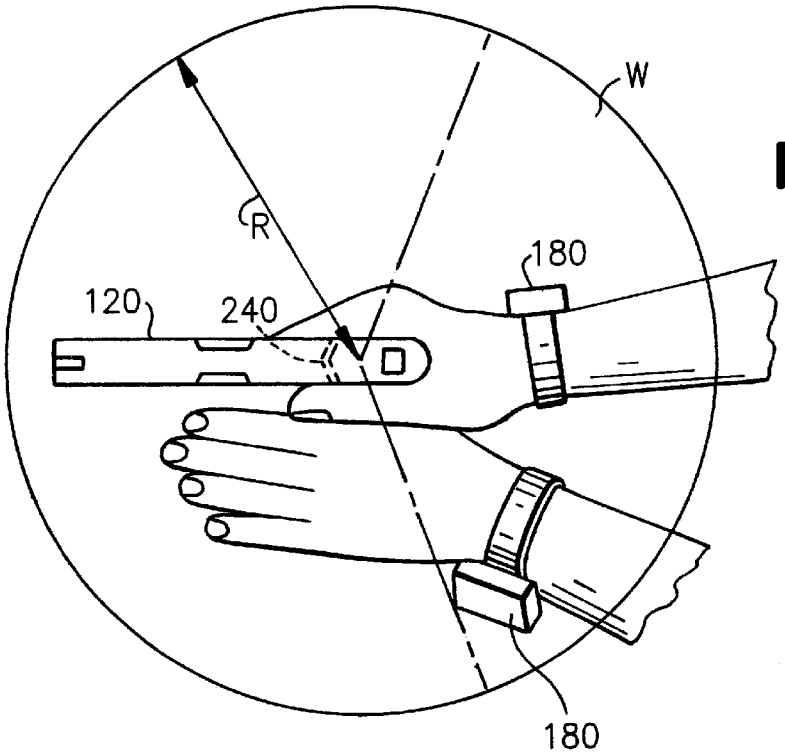
FIG. 13 is a top schematic plan view of the pistol shown in FIG. 8 being held by a user.

Referring now to FIG. 13, a schematic top plan view of the pistol 120 being held by a user is shown. In this figure the user has two units 180 provided as wrist band units; one on each wrist. One of the goals in designing the communications system of the present inventions is to provide a pistol for law enforcement that provides more protection to an officer in a take-away situation. Since most take-away scenarios are at close quarters, with the worst case scenario being a surprise take-away from behind, it is important that the transponder enabling distance be as small as possible. The magnetic signaling technique described above can operate over a range of up to 36 inches and can be easily de-tuned to operate at shorter distances. In a preferred embodiment the range R is about 8 inches. As FIG. 13 shows, an 8-inch radius would include the entire wrist and portion of the lower forearm. This would allow the user to locate a transponder on a wristband, bracelet, sweatband or into a uniform sleeve. A larger enabling distance only diminishes the amount of protection that the pistol can offer in a take-away situation.

Since the enabling distance will be kept to a minimum, weak hand shooting would require that another transponder be worn on the weak hand. The firearm communications package will distinguish between the two transponders and eliminate contention, or interference between the two transponders when both are in close proximity to the pistol. Since the firearm electronic communications package will include a microprocessor, the program software will handle contention. Each transponder will transmit its own identity when polled by the firearm; the "dominant" responding transponder will then take control of the remaining communications. By defining a wedge shaped area W behind the firearm as the enabling zone, the amount of protection offered in a struggle or take-away situation is greatly enhanced. For a magnetic signaling system a Faraday shield 240 could be provided on the pistol 120 to define the wedge shaped area W.

Figure 14:
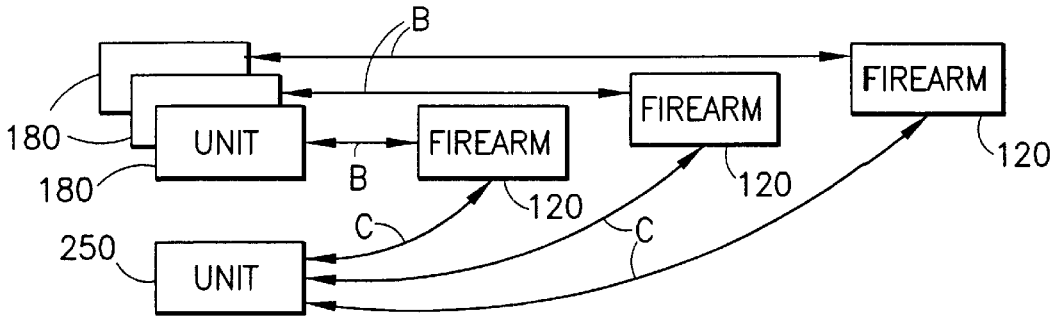
FIGS. 14 and 15 are schematic diagrams of systems having multiple firearms and units.
Figure 15:
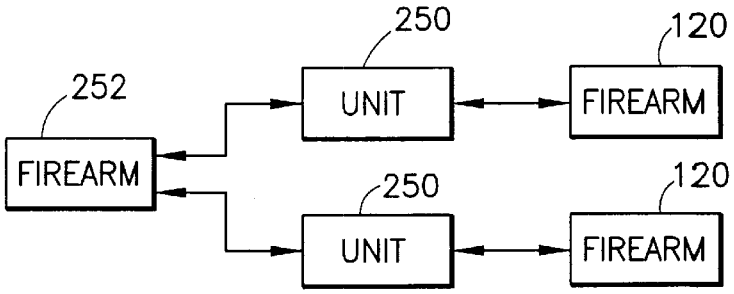

Referring now to FIG. 14, in a law enforcement agency there will be multiple firearms 120. Preferably, each firearm 120 will have a specifically coded communication unit 180 that can only be used with the particular firearm as illustrated by lines B. However, preferably a second type of unit 250 can be provided, such as for a supervisor, that can be used with multiple firearms as illustrated by lines C. Referring also to FIG. 15, a firearm 252 could also be adapted to function with either one of two or more units 250 wherein the units 250 are also adapted to function singularly with the respective firearms 120. This could be provided in a situation such as when the firearms 120 are pistols of two officers working as partners, each officer having one of the units 250, and the firearm 252 is a vehicle carried firearm, such as a shotgun. Thus both officers could use the shotgun, but they could not interchange use of their respective pistols.

Figure 16:
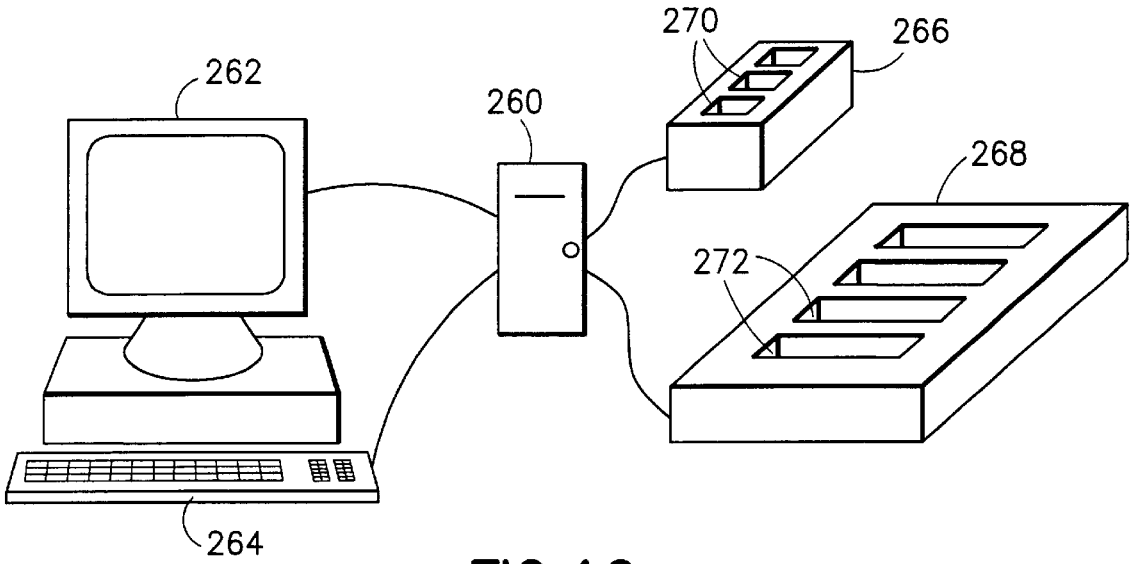
FIG. 16 is a schematic diagram of a PC based programming unit.

Referring also to FIG. 16, a personal computer (PC) based reprogramming system is shown. The system includes a computer 260, a monitor 262, a keyboard 264, a first unit input/output device 266 and a second firearm input/output device 268. The unit input/output device 266 has seats 270 and electrical contacts (not shown) in each seat that are connected to the computer 260. Units 180, 250 are provided with electrical contacts connected to their controllers 198. When the units 180 are inserted into the seats 270 the contacts form an electrical connection between the controllers 198 and the computer 260. The computer 260 can be used to change the stored acceptable polling signal(s) in the controllers. The firearm input/output device 268 has seats 272 and electrical contacts (not shown) in each seat that are connected to the computer 260. Firearms 120 are provided with electrical contacts connected to their communications package controllers 164. When the pistols 120 are inserted into the seats 272 the contacts form an electrical connection between the controllers 164 and the computer 260. The computer can be used to change the stored acceptable return signal(s) in the controllers 164. Thus, stored acceptable or communication protocols can be changed, added or removed as desired to increase security. Of course, access to change stored acceptable signal(s) identification can be password protected and/or encrypted. In addition, changeability of stored communication protocols need not be provided; i.e.: a read only system. The PC system could also be used to perform diagnostics on the firearm and transponder communications package. In an alternate embodiment, one or both of the input/output devices 266, 268 do not need electrical contacts to communicate with the firearms and/or units. Instead, the devices 266, 268 could have coil antenna and the devices, firearms and units could be configured to partially or solely communicate by magnetic coded signals for diagnostics and/or reconfiguration and changing of codes.

The personal computer based stations could have different levels of accessibility and function. The highest level programming station would be located within a police station, having a designated and authorized person in charge of tracking and modifying, if necessary, each officer's firearm access codes. Lower level stations could be located on the officer's home computer or connected to a portable computer that would only allow the officer to perform an operational status check of the firearm, and not allow access code changes. The operation check could also be made in the squad car if it were so equipped.

It is currently conceivable to use a 32-bit code that would allow the use of over 4.2 billion different enabling codes. However, if operational speed becomes a concern, the code length can be shortened to a more convenient length that will optimize the time it would take for the firearm to become armed.

Since the pistol's communications package requires very little current to operate and even less in standby mode, it is conceivable that the batteries in the transponder and base communications packages will last for over 5 years. These batteries can be hermetically sealed together with the communications package to increase survivability and reliability of the system. Therefore they would not be a user replaceable item.

Battery life is another trade-off item, i.e. depending on how many are used, and how many codes and program operations that the firearm will have to process every time that it operates. The device that converts electrical energy to mechanical energy, the actuator 136, will require more current. At this time, we believe that this battery should be a user replaceable item. This could be subject to change, if an actuator that requires less battery current is used.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A firearm safety system comprising:

a first communications system on a firearm;

a second communications system carried on a user separate from the firearm; and means for limiting communications between the first and second communications systems, at least partially, to a rearward facing path of less than about 180° at a rear end of the firearm.

2. A system as in claim 1 wherein at least one of the communications systems comprises means for transmitting coded magnetic signals.

3. A system as in claim 2 wherein the means for limiting comprises a partial Faraday shielding at a magnetic transponder reader on the firearm.

4. A system as in claim 1 wherein the means for limiting comprises the first communications systems having a directional antenna.

5. A system as in claim 1 wherein the means for limiting comprises the second communications system having a partial Faraday shield around a transmitting antenna of the second communications system.

6. A system as in claim 1 further comprising a third communication system carried on the user separate from the firearm and the second communications system, and means for preventing signals from the second and third communication system from interfering with each other.

* * * * *